US007921929B2

(12) United States Patent
Wielgat et al.

(10) Patent No.: US 7,921,929 B2
(45) Date of Patent: Apr. 12, 2011

(54) APPARATUS AND METHOD FOR EXTINGUISHING FIRES IN A MULTI-FLOORED BUILDING

(76) Inventors: Michael Wielgat, Chicago, IL (US); Daniel J. Kegg, Gurnee, IL (US)

( * ) Notice: Subject to any disclaimer, the term of this patent is extended or adjusted under 35 U.S.C. 154(b) by 413 days.

(21) Appl. No.: 12/099,247

(22) Filed: Apr. 8, 2008
(Under 37 CFR 1.47)

(65) Prior Publication Data

US 2009/0250232 A1 Oct. 8, 2009

(51) Int. Cl.
*A62C 3/00* (2006.01)

(52) U.S. Cl. ..... 169/67; 169/70; 169/51; 169/52; 169/54; 182/51; 182/52

(58) Field of Classification Search ..... 169/67, 169/70, 51, 52, 54; 182/36, 51, 52
See application file for complete search history.

(56) References Cited

U.S. PATENT DOCUMENTS

| | | | | | |
|---|---|---|---|---|---|
| 245,168 | A | | 8/1881 | Hopkins | |
| 440,827 | A | * | 11/1890 | Hoffman | 182/51 |
| 473,716 | A | | 4/1892 | Stevens | |
| 483,001 | A | | 9/1892 | Hughes | |
| 524,795 | A | * | 8/1894 | Walker | 137/317 |
| 589,244 | A | | 8/1897 | Cantore | |
| 640,645 | A | * | 1/1900 | Fall | 182/51 |
| 1,003,967 | A | * | 9/1911 | Magliocca | 182/51 |
| 1,183,960 | A | * | 5/1916 | Ecker et al. | 182/2.5 |
| 2,446,093 | A | | 7/1948 | Lambert | |
| 3,212,604 | A | | 10/1965 | Garnett | |
| 3,337,071 | A | | 8/1967 | Clark | |
| 4,043,397 | A | | 8/1977 | Glowienke | |
| 4,103,841 | A | | 8/1978 | Flynn et al. | |
| 4,261,434 | A | | 4/1981 | Mitchell | |
| 4,470,229 | A | | 9/1984 | Muse et al. | |
| 6,035,940 | A | | 3/2000 | Bourke | |
| 6,425,537 | B1 | | 7/2002 | Nielsen | |
| 6,881,021 | B1 | | 4/2005 | Winter et al. | |
| 7,028,783 | B2 | | 4/2006 | Celorio-Villasenor | |
| 7,299,883 | B2 | | 11/2007 | Wielgat | |
| 2002/0100898 | A1 | | 8/2002 | Knoerzer et al. | |

* cited by examiner

*Primary Examiner* — Dinh Q Nguyen
(74) *Attorney, Agent, or Firm* — Ungaretti & Harris LLP

(57) ABSTRACT

An improved apparatus for treating a fire in a multi-floored building where the fire is located on an upper floor vertically displaced from a lower floor from which the fire is treated, and where the upper and lower floors each have a selectively openable environmental access along an external wall of the multi-floored building. The improved apparatus includes a tubular structure having an inlet, an intermediate portion, and an outlet and a bracing system. The bracing system has a frame, a first pivot point, and a second pivot point. The frame provides support against a sturdy surface. The tubular structure is supported on the first pivot point and rotates thereon to elevate or hoist the outlet towards the upper floor environmental access. The tubular structure is further supported on a second pivot point and further rotates thereon to elevate the outlet.

16 Claims, 7 Drawing Sheets

APPARATUS AND METHOD FOR EXTINGUISHING FIRES IN A MULTI-FLOORED BUILDING

TECHNICAL FIELD

The invention relates to an apparatus for fighting fires. More specifically, the present invention relates to an apparatus including a portable apparatus and method for extinguishing a fire in a multi-floored building.

BACKGROUND

It is often difficult to extinguish a fire in a high-rise building because the floor or floors on which the fire is located is/are inaccessible due to the heat accompanying the fire. This excessive heat will often cause windows to blow out. The open windows allow oxygen to feed the fire creating an even more difficult situation.

High-rise buildings typically have sprinkler systems to help extinguish fires and help firefighters access the burning floors. Many times, these sprinkler systems are not sufficient to battle a hot and out of control fire, especially when the windows of the building have already blown out. Some older buildings have no sprinkler systems at all. If the fire is located on a lower floor, a fire truck waterway can be used to douse the burning floor with water or foam. However, when the floor is beyond the reach of the waterway, there is very little chance that firefighters will be able to access the burning floors until some cooling takes place.

One method and apparatus for treating a fire in a multi-floored building is disclosed in commonly owned U.S. Pat. No. 7,299,883, which is hereby incorporated by reference as if fully set forth herein. The '883 patent discloses a means for treating a fire located on a first floor vertically displaced from a second floor from which the fire is treated. The first and second floors each have a selectively openable environmental access along an external wall of the multi-floored building. A tubular member is hoisted on a pivot point up to a higher floor environmental access from a lower floor environmental access. One drawback of the method and apparatus of the '883 patent is the difficulty in hoisting the tubular member outwardly from the lower floor access and upwardly to the second floor access.

The present invention is provided to solve the problems discussed above and other problems, and to provide advantages and aspects not provided by prior fire fighting equipment. A full discussion of the features and advantages of the present invention is deferred to the following detailed description, which proceeds with reference to the accompanying drawings.

SUMMARY OF THE INVENTION

A first aspect of the present invention is directed to an apparatus for treating a fire in a multi-floored building where the fire is located on an upper floor vertically displaced from a lower floor from which the fire is treated. The upper and lower floors each have a selectively openable environmental access along an external wall of the multi-floored building. The apparatus comprises a tubular structure and a bracing system. The tubular structure has an inlet, an intermediate portion, and an outlet. The bracing system comprises a frame, a first pivot point and a second pivot point. The frame provides support against a sturdy surface. The tubular structure is supported on the first pivot point and rotates thereon to elevate the outlet. The tubular structure is further supported on the second pivot point and also rotates thereon to elevate the outlet. The first pivot point may be located on a separate horizontal plane than the second pivot. The first pivot point may also be located above the second pivot point.

The bracing system of this aspect of the invention may further comprise a boom. The boom is attached to the tubular structure and defines the second pivot point.

The bracing system of this aspect of the invention may further comprise a stabilizing roller on the frame defining the first pivot point.

The bracing system of this aspect of the invention may further comprise a guide on the frame upon which the boom traverses from an entry end of the guide to a terminal end of the guide.

The bracing system of this aspect of the invention may further comprise a pair of rollers on the boom located on opposite sides of the tubular structure. The rollers engage the guide and are traversable thereon.

The bracing system of this aspect of the invention may further comprise a pair of spaced tracks. Each track comprises a pair of spaced rails between which each of the rollers traverses.

The bracing system of this aspect of the invention may further comprise a keeper associated with the guide and engaging the boom to restrict backtracking of the boom toward the terminal end of the guide.

The bracing system of this aspect of the invention may further comprise a retaining bar attached to the tubular structure and engageable with a portion of the bracing system to further restrict backtracking of the boom towards the entry end of the guide.

The bracing system of this aspect of the invention may further comprise a bracket attached to the frame and aligned with a portion of the retaining bar. The bracket has a receiver into which the portion of the retaining bar is received to prevent backtracking of the boom.

Another aspect of the present invention is directed to an apparatus for treating a fire in a multi-floored building where the fire is located on an upper floor vertically displaced from a lower floor from which the fire is treated. The upper and lower floors each have a selectively openable environmental access along an external wall of the multi-floored building. The apparatus comprises a tubular structure and a bracing system. The tubular structure has an inlet, an intermediate portion, and an outlet. The bracing system comprises a frame and a boom. The frame has a stabilizer defining a first pivot point against which the tubular structure is supported and a guide having an entry end and a terminal end opposite the entry end. The boom is attached to the tubular structure and operably engages the guide wherein the guide restricts vertical displacement of the boom and wherein a portion of the boom is capable of a traverse on the guide from the entry end to the terminal end such that the traverse forces pivoting action of the tubular structure against the stabilizer causing a reciprocal movement by the outlet upwardly. The apparatus may further comprise a second pivot point associated with the boom.

The bracing system of this aspect of the invention may further comprise a pair of spaced tracks upon which the boom traverses.

The bracing system of this aspect of the invention may further comprise a pair of rollers attached to the boom and engaging the pair of spaced tracks upon which the boom traverses.

The bracing system of this aspect of the invention may further comprise a pair of spaced rails between which each of the rollers traverses.

The bracing system of this aspect of the invention may further comprise a pair of keepers associated with each of the tracks. The keepers restrict backtracking of the rollers on the guide toward the entry end of the guide.

The bracing system of this aspect of the invention may further comprise a retainer bar attached to the tubular structure and engageable with a portion of the frame to further restrict backtracking of the rollers.

Another aspect of the present invention is directed to a method for treating a fire in a multi-floored building where the fire is located on an upper floor vertically displaced from a lower floor from which the fire is treated. The upper and lower floors each have a selectively openable environmental access along an external wall of the multi-floored building. The method comprises the steps of: (1) providing a tubular structure having an inlet, an intermediate portion, and an outlet; (2) providing a bracing system comprising a first pivot point and a second pivot point; (3) engaging the first pivot point with the intermediate portion of the tubular structure; (4) pushing the tubular structure against the first pivot point while restricting vertical displacement of the inlet of the tubular structure; and (4) pivoting the tubular structure about the first and second pivot points to hoist the outlet of the tubular structure upwardly.

Still another aspect of the present invention is directed to an apparatus for treating a fire in a multi-floored building, the fire located on an upper floor vertically displaced from a lower floor from which the fire is treated, the upper and lower floors each having a selectively openable environmental access along an external wall of the multi-floored building. The apparatus comprises:

a tubular structure having an inlet, an intermediate portion, and an outlet; and a bracing system comprising:

a frame for providing support against a sturdy surface; and a displaceable pivot point supported by the frame upon which the tubular structure is supported and rotates thereon to elevate said outlet, the displaceable pivot point having a first position on the frame to a second position on the frame.

The bracing system of this aspect of the invention may further comprise a fixed pivot point upon which the tubular structure is further supported and rotates thereon to elevate the outlet.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
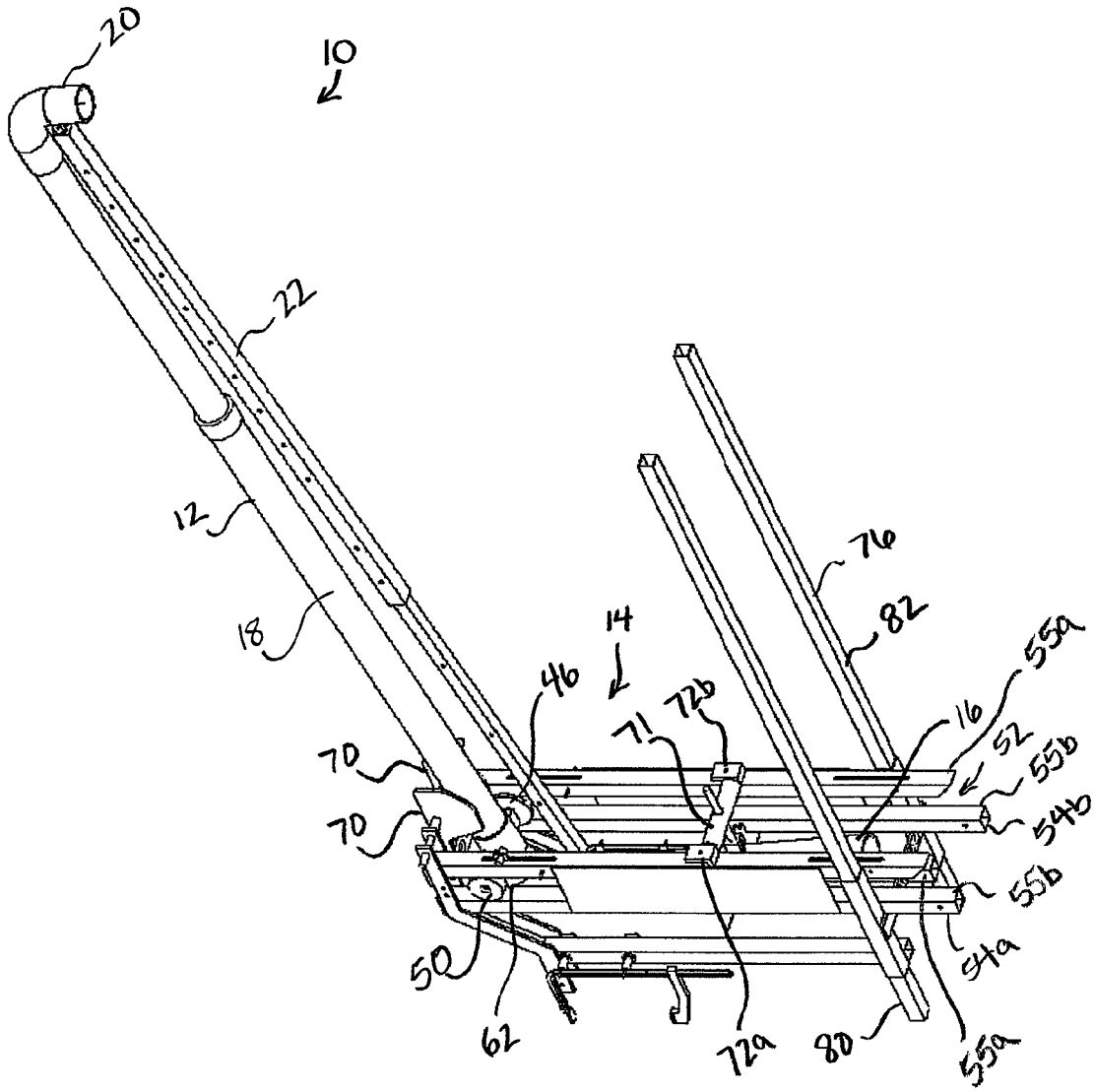
FIG. 1 is a perspective view of an apparatus for treating a fire in a multi-floored building comprising a fully assembled system of the present invention.
Figure 2:
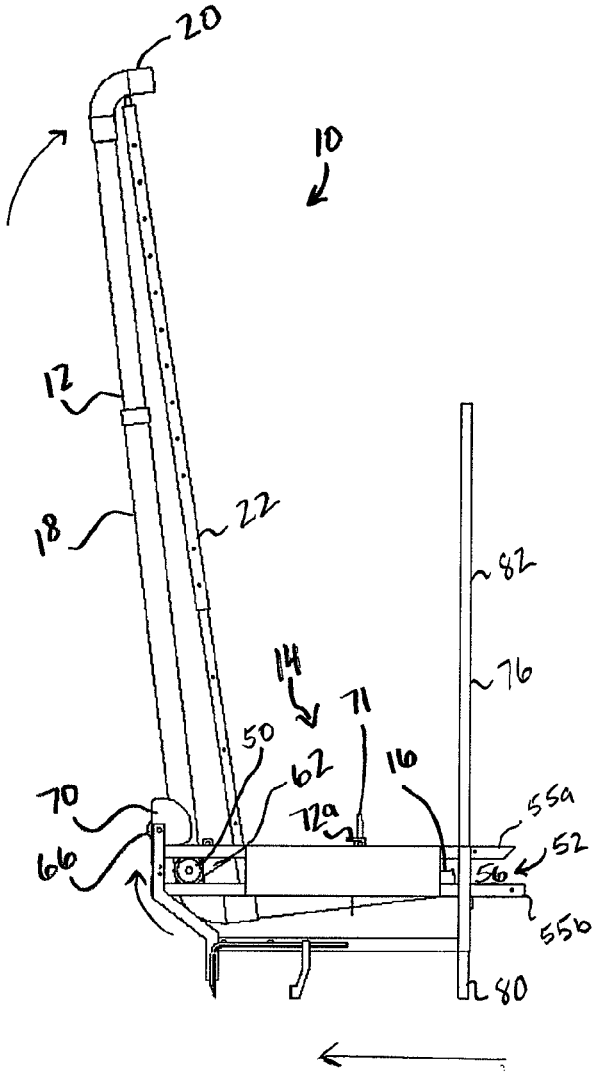
FIG. 2 is a side view of the present invention.
Figure 3:
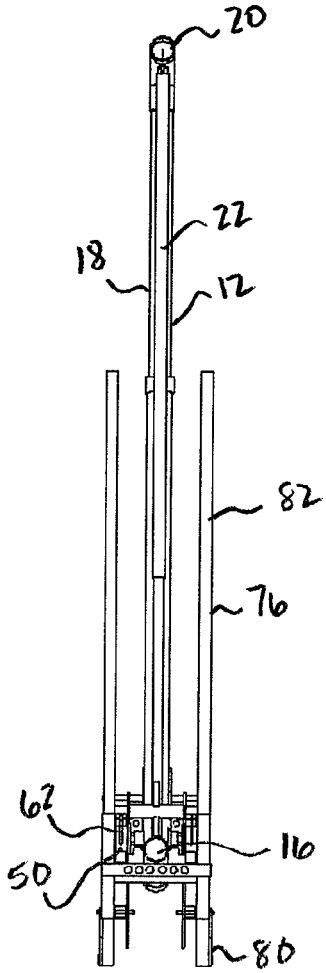
FIG. 3 is a front view of the present invention.
Figure 4:
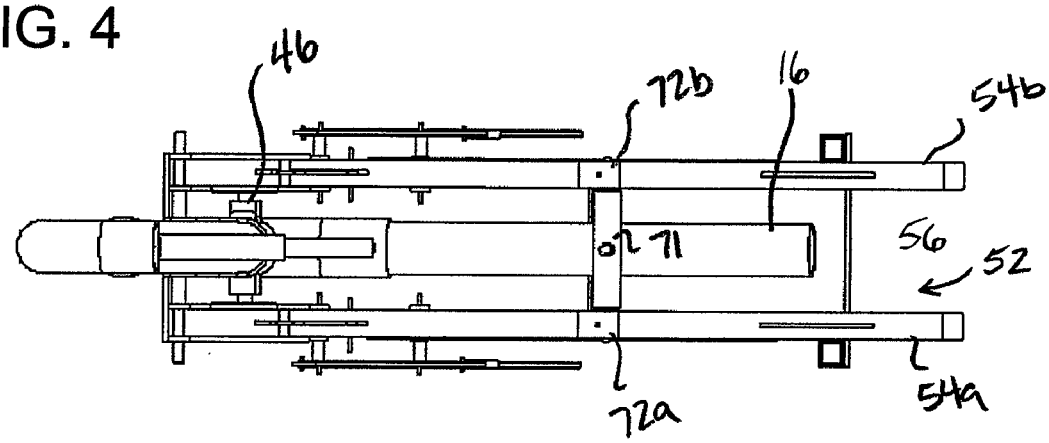
FIG. 4 is a top view of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

LISTING OF REFERENCE NUMBERS

Apparatus 10;
Curvilinear tubular structure 12;
Bracing system 14;
Inlet 16;
Intermediate portion 18;
Outlet 20;
Telescoping support member 22;
Rigid frame 44;
Boom 46;
Boom roller 50;
Guide 52
Tracks 54*a,b;*
Rails 55*a,b;*
Entry end of guide 56;
Terminal end of guide 58
Keepers 62;
Stabilizer roller 66;
Plates 70;
Retainer bar 71;
Brackets 72*a,b;*
Extendable frame 76
Extendable frame lower portion 80; and
Hydraulic jacks 82.

The present invention is directed to an apparatus for treating a fire in a multi-floored building, a method of treating fire in a multi-floored building, and a portable apparatus for assembly and subsequent treating of a fire in a multi-floored building. It is contemplated that various disclosures described herein are used to treat a fire located on a first floor that is vertically displaced from a second floor from which the fire is treated. The first and second floors each have a selectively openable environmental access, e.g. a window or other suitable opening, along an external or outer wall of the multi-floored building.

The apparatus of the present invention is preferably supplied as a system in multiple smaller components that can be transported to a location and assembled in various sizes, lengths, and shapes.

Referring to the FIGS. 1-11, an apparatus 10 for treating a fire in a multi-floored building is illustrated. The apparatus 10 includes a curvilinear tubular structure 12 and a bracing system 14.

The curvilinear tubular structure 12 has an inlet 16 for receiving a fluid pressure on a lower floor from a source of a fluid pressure, an intermediate portion 18, and an outlet 20 for delivering the fluid pressure to an upper floor. The intermediate portion 18 is located between the inlet 16 and the outlet 20 and is adapted for extension from a lower floor environmental access to a point adjacent; i.e. either inside or outside, an upper floor environmental access. A nozzle may be attached to the outlet to redirect the fluid pressure.

The curvilinear tubular structure 12 is generally produced from a metallic material such as a steel, a stainless steel, or an anodized aluminum or alloy thereof, but can also be produced from polymeric substances such as polyvinyl chloride. The diameter of the tubular segments is typically on the order of about 2½ ins.

The curvilinear tubular structure 12 generally includes a plurality of tubular segments joined together, end-to-end. Any number of tubular segments may be provided; however, at least two curvilinear tubular segments separated by at least one straight segment are preferably provided to allow the fluid pressure to be transferred from safely inside the lower floor to inside the upper floor. These curvilinear tubular segments can take any angle between just greater than 0° and 180°, but are preferably made up of segments angled 45° and 90°. Siamese segments or any other type T-shape or Y-shape can also be provided as needed.

The curvilinear tubular structure 12 is preferably a telescopic waterway assembly. The telescopic waterway assembly is adapted to selectively vary the length of the intermediate portion 18.

The tubular structure 12 is arranged such that a distal member forms the outlet 20 which may be selectively located on the first or upper floor, and a proximal member forms the inlet 16 which may be selectively located on the second or lower floor.

Figure 5:
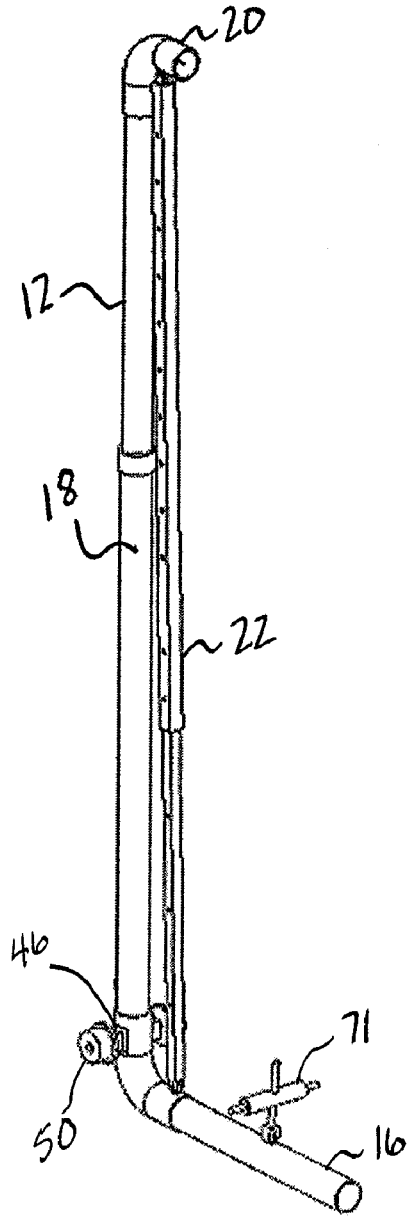
FIG. 5 is a perspective view of a curvilinear tubular structure with a boom and a retainer bar attached thereto.
Figure 6:
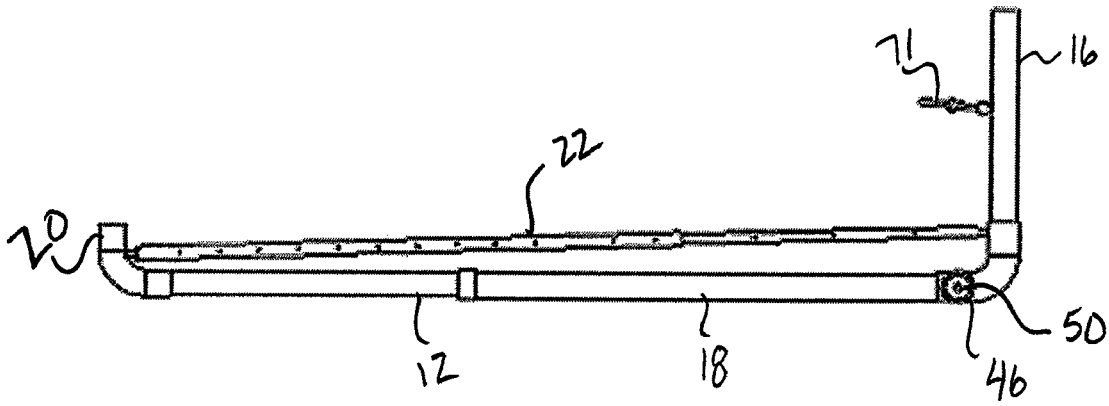
FIG. 6 is a side view of the curvilinear tubular structure with a boom and a retainer bar attached thereto.
Figure 7:
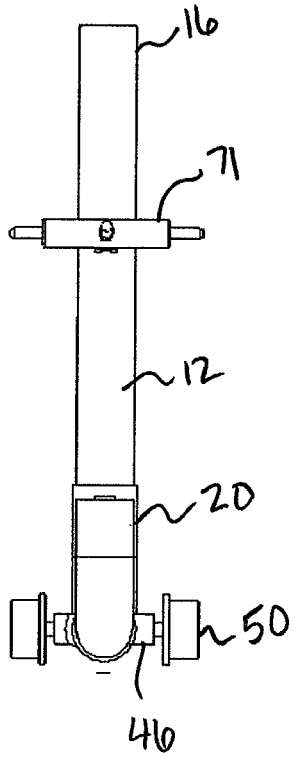
FIG. 7 is a top view of the curvilinear tubular structure with a boom and a retainer bar attached thereto.
Figure 8:
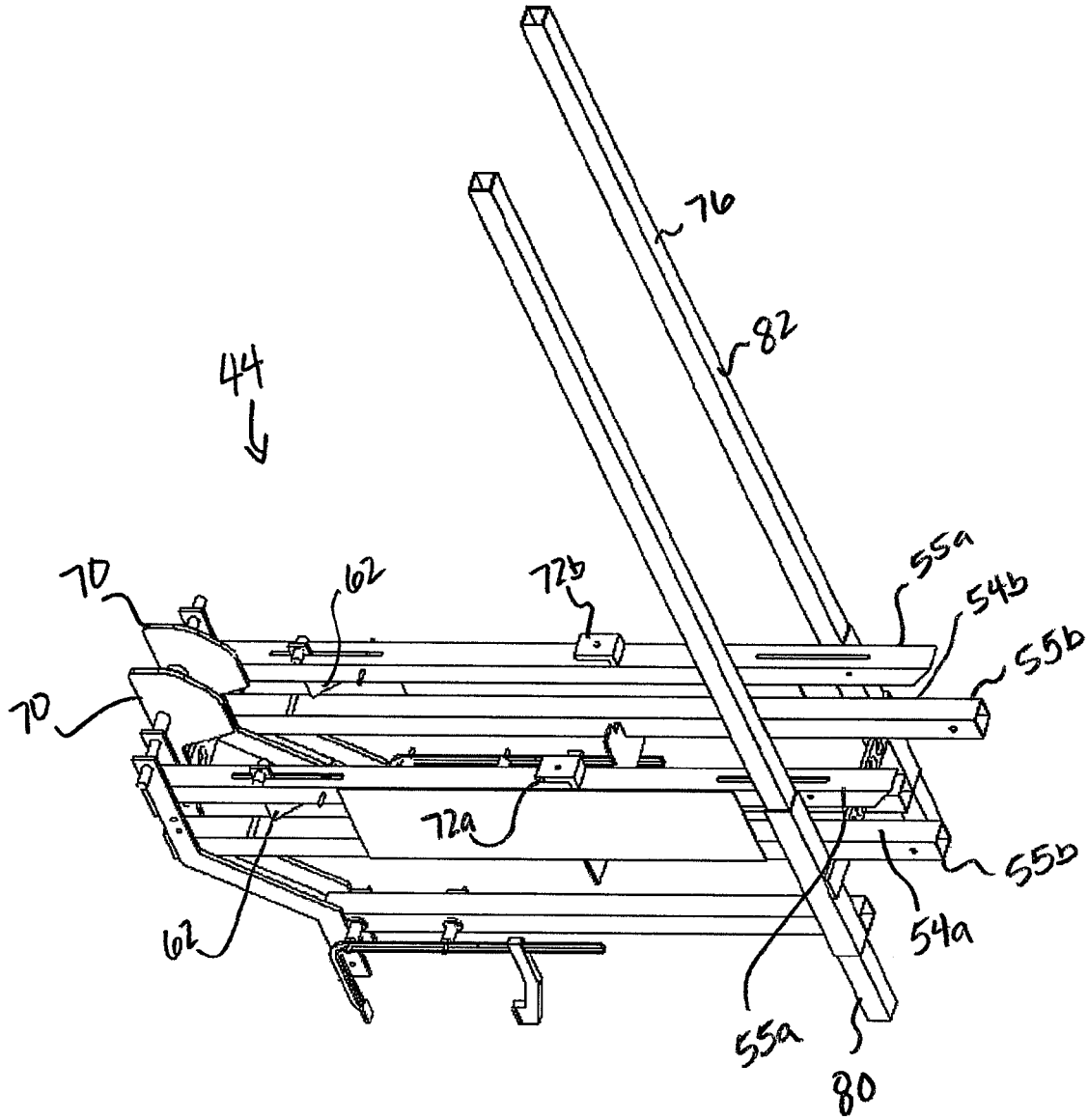
FIG. 8 is a perspective view of a bracing system, minus the boom and the retainer bar, for use with the apparatus of the present invention.
Figure 9:
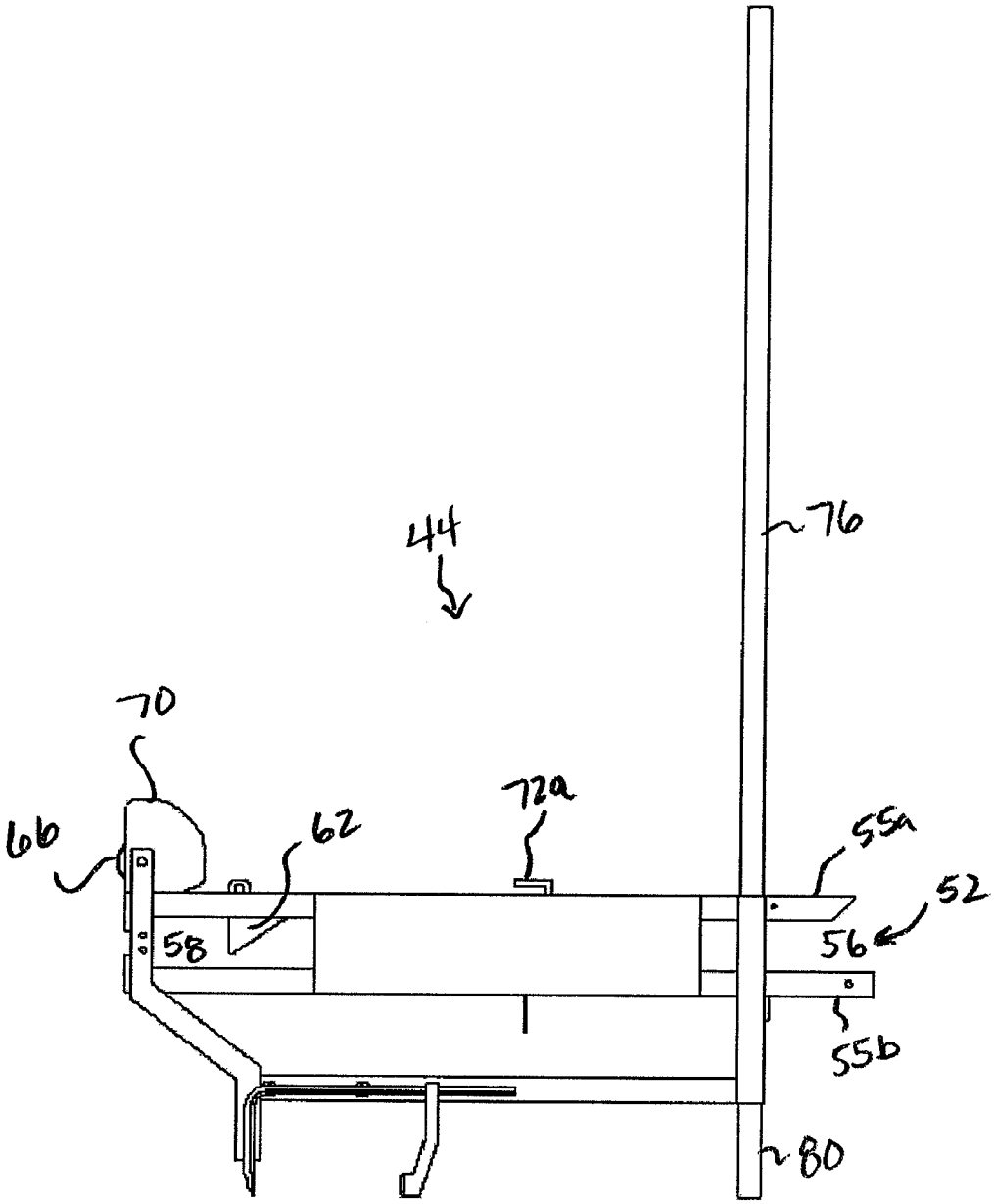
FIG. 9 is side view of the bracing system, minus the boom and the retainer bar.
Figure 10:
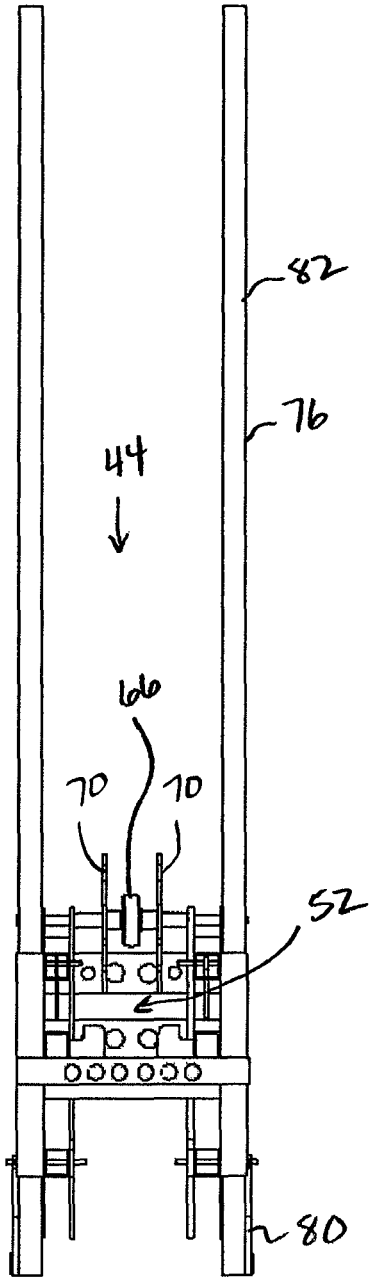
FIG. 10 is a front view of the bracing system, minus the boom and the retainer bar.
Figure 11:
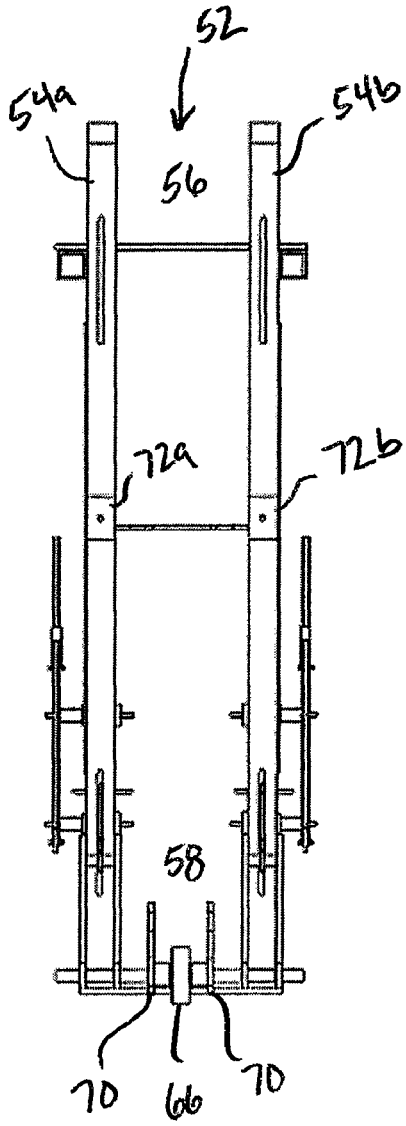
FIG. 11 is a top view of the bracing system, minus the boom and the retainer bar.

As best illustrated in FIGS. 5-7, the tubular structure 12 includes a telescoping support member 22 having one end attached adjacent the outlet 20 and spanning the length of the intermediate segment and having an opposite end attached adjacent the inlet 16. The support member 22 adds stiffness to the tubular structure 12. It also retains the telescoping tubular structure in the desired length. In other words, it prevents the tubular structure 12 from changing length due to external factors and/or the force from the fluid pressure.

The bracing system of this embodiment includes a rigid frame 44 and boom 46. The rigid frame 44 is extendable from the lower floor environmental access, and is attachable to a portion of the multi-floored building through the use of a lever clam, such as the lever clamp sold by Bessey, Inc. under the name J-Series Lever Clamp, attached to a lower portion of the frame 44. The frame 44 provides support for the apparatus 10 against a sturdy surface, preferably a portion of the building.

The boom 46 is attached to the intermediate segment 18 of the tubular structure 12. One purpose of the boom 46 is to provide another contact point between the tubular structure 12 and the frame 44. The boom 46 preferably includes a pair of rollers 50 arranged such that a roller is located on opposing sides of the tubular structure 12. The rollers 50 are attached in a manner that allows them to free wheel on an axle. The purpose of the rollers 50 will become clear upon further discussion.

The rigid frame 44 includes a guide 52. The rollers 50 of the boom 46 are adapted traverse the guide 52 and pivot thereon. This includes pivoting action between the axle of the boom 46 and the rollers 50, as the opposite force provided to achieve the pivoting is provided by the frame 44, more precisely the guide 52, such that relative rotational or pivoting action takes place between the boom 46 and the frame 44. In other words, the boom 46 pivots against the frame 44. Preferably, the guide 52 include pairs of opposing tracks 54*a*,54*b*, each having a pair of opposing upper and lower rails 55*a*,55*b* between which the rollers 50 travel from an entry end 56 where the rollers 50 are inserted between the rails 55*a*,55*b* to a terminal end 58 of the guide 52. Thus, the boom 46 and guide combination restricts unwanted or undesirable vertical displacement of the tubular structure 12 during use while providing a traversing pivot point to allow a component of displacement other than the pivoting action, thus creating a displaceable pivot point. In other words, while the tubular structure 12 is pivoting against the frame on the roller axis, it may be traversing along the frame, preferably outwardly from the environmental access with a horizontal component of displacement, although the traversing action may have two dimensional or even three dimensional displacement.

A pair of tapered keepers 62 are located on the guide 52. Preferably, the keepers 62 descend from the upper rails 55*a*. As the rollers 50 traverse outwardly from the environmental access on the lower floor and towards the terminal end of the guide 52, the rollers 50 contact the taper on the keepers 62. This forces the keepers 62 upwardly through slots in the upper rails 55*a*, allowing the rollers 50 to continue to the terminal end 58 of the guide 52. As the rollers 50 clear the keepers 62, the keepers 62 drop to prevent the rollers 50 from backtracking towards the entry end 56.

The frame 44 further includes a stabilizer defining another pivot point. This pivot point is fixed. The stabilizer allows the intermediate portion 18 of the tubular structure 12 to be supported by the frame 44 and preferably reduces friction between the frame 44 and the tubular structure 12 allowing the tubular structure 12 to slide against the frame 44 more easily. More preferably, the stabilizer is a smooth or polished surface to reduce friction. Most preferably, the stabilizer includes a stabilizing roller 66, located above the terminal end 58 of the guide 52. The stabilizing roller 66 separates a pair of plates 70 which are adapted, as is sized and spaced, to receive the intermediate portion 18 of the tubular structure 12 therein.

The bracing system further includes a retainer bar 71 attached to the inlet segment 16 of the tubular structure 12. The retainer bar 71 is substantially T-shaped and fixedly attached to an upper portion of the inlet segment 16 such that an upright portion of the retainer bar 71 is substantially parallel with the intermediate segment 18. A crossbar of the retainer bar 71 is substantially perpendicular to the upright portion and has a pair of fittings on opposite ends. The purpose of the retainer bar 71 will become clear upon further description.

The frame 44 also includes a pair of brackets 72*a*,72*b* for receiving portions of the retainer bar 71 therein. Preferably, the brackets 72*a*,72*b* include receivers, preferably slots, for receiving the fittings therein. These brackets 72*a*,72*b* in combination with the keepers 62 help retain the apparatus 10 in the desired position during use.

The bracing system may further include an extendable frame 76. The extendable frame 76 is attachable to the frame 44. The extendable frame 76 includes hydraulic jacks 82, such hydraulic bracing bars sold by Save-A-Load, Inc. under the name Save-A-Load®, provided for extending the extendable frame 76 upwardly against a portion of the lower floor of the building, preferably the ceiling.

Taken in conjunction with the description above, a method for treating a fire in a multi-floored building where the fire is located on a first floor vertically displaced from a second floor from which the fire is treated is also disclosed in the FIGS. 1-11. The first and second floors each have a selectively openable environmental access, preferably a window, which may be opened, blown out by the fire, or purposely broken by the fire fighters to create access to the flames. The method comprises one or more of the following the steps of: attaching the frame 44 to the building at the environmental access of the lower floor; adjusting a length of the tubular structure 12 to an appropriate length such that the inlet 16 is located adjacent, either inside or outside, the environmental access at the lower floor, and the outlet 20 is located adjacent the environmental access, either inside or outside, at the upper floor; resting the tubular structure 12 on a portion of the frame, preferably on the stabilizing roller 66; forcing the tubular structure 12 outwardly against the portion of the frame 44; engaging the boom 46 with the frame 44, preferably inserting the boom rollers 50 within the guide 52 between on tracks 54*a*,54*b* between the rails 55*a*,55*b*; continuing forcing of the tubular structure 12 outwardly while restricting the vertical displacement of the boom 46 such that the tubular structure 12 pivots against the stabilizer on the frame 44 and the outlet 20 of the tubular structure 12 raises toward the upper floor environmental access as the boom 46 pivots against the frame 44; and locking the boom 44 into place, preferably using a combination of the keepers 54*a*,54*b* and/or the brackets 72*a*,72*b*.

One of the advantages of the apparatus 10 disclosed herein is that the apparatus 10 has duel pivot points. The duel pivot points allow a force in a single direction to transfer movement in two directions to the tubular structure 12. One of accomplishing this is to offset first and second pivot points on separate horizontal planes, with the first pivot point preferably defined by the stabilizer located above the second point defined by the contact points between the boom 46 and the guide 52. For example, as fire fighters push the tubular structure 12 outwardly against the stabilizing roller 66 while inserting the boom 46 rollers 50 within the guide 52 tracks 54*a*,54*b* between the rails 55*a*,55*b*, the tubular structure 12 pivots against the stabilizing roller 66 and the boom 46 pivots against the frame 44 to elevate the outlet 20 of the tubular structure 12 upwardly to the higher floor environmental access as the tubular structure 12 is also moving horizontally outwardly toward the terminal end 58 of the guides 52. These movements are designated by the arrows on FIG. 2.

While the specific embodiments have been illustrated and described, numerous modifications come to mind without significantly departing from the spirit of the invention, and the scope of protection is only limited by the scope of the accompanying Claims.

What is claimed is:

1. An apparatus for treating a fire in a multi-floored building, the fire located on an upper floor vertically displaced from a lower floor from which the fire is treated, the upper and lower floors each having a selectively openable environmental access along an external wall of the multi-floored building, the apparatus comprising:

a tubular structure having an inlet, an intermediate portion, and an outlet; and a bracing system comprising:

a frame for providing support against a sturdy surface;

a first pivot point upon which said tubular structure is supported and rotates thereon to elevate said outlet;

a second pivot point upon which said tubular structure is further supported and rotates thereon to elevate said outlet;

a boom attached to said tubular structure said boom defining said second pivot point a pair of rollers on said boom located on opposite sides of said tubular structure, said rollers engaging said guide and traversable thereon; and a pair of spaced tracks, each track comprising a pair of spaced rails between which each of said rollers traverses.

2. The apparatus of claim 1 wherein said first pivot point is located on a separate horizontal plane than said second pivot.

3. The apparatus of claim 2 wherein said first pivot point is located above said second pivot point.

4. The apparatus of claim 1 wherein said bracing system further comprises:

a stabilizing roller on said frame defining said first pivot point.

5. The apparatus of claim 1 wherein said bracing system further comprises:

a keeper associated with said guide engaging said boom and restricting backtracking of said boom toward said terminal end of said guide.

6. The apparatus of claim 5 wherein said bracing system further comprises:

a retaining bar attached to said tubular structure engageable with a portion of said bracing system to further restrict backtracking of said boom towards said entry end of said guide.

7. The apparatus of claim 6 wherein said bracing system further comprises:

a bracket attached to said frame and aligned with a portion of said retaining bar and having a receiver into which said portion of said retaining bar is received to prevent backtracking of said boom.

8. An apparatus for treating a fire in a multi-floored building, the fire located on an upper floor vertically displaced from a lower floor from which the fire is treated, the upper and lower floors each having a selectively openable environmental access along an external wall of the multi-floored building, the apparatus comprising:

a tubular structure having an inlet, an intermediate portion, and an outlet; and a bracing system comprising:

a frame having a stabilizer defining a first pivot point against which said tubular structure is supported and a guide having an entry end and a terminal end opposite the entry end; and a boom attached to said tubular structure and operably engaging with said guide wherein said guide restricts vertical displacement of said boom and wherein a portion of said boom is capable of a traverse on said guide from said entry end to said terminal end such that said traverse forces pivoting action of said tubular structure against said stabilizer causing a reciprocal movement by said outlet upwardly.

9. The apparatus of claim 8 further comprising:

a second pivot point associated with said boom.

10. The apparatus of claim 9 wherein said second pivot point occurs along a length of the guide.

11. The apparatus of claim 10 wherein the bracing system further comprises:

a pair of spaced tracks upon which the boom traverses.

12. The apparatus of claim 11 wherein the bracing system further comprises:

a pair of rollers attached to said boom and engaging said pair of spaced tracks upon which the boom traverses.

13. The apparatus of claim 12 wherein each spaced track comprises:

a pair of spaced rails between which each of said rollers traverses.

14. The apparatus of claim 13 wherein the bracing system further comprises:

a retainer bar attached to said tubular structure and engageable with a portion of said frame to further restrict backtracking of said rollers.

15. An apparatus for treating a fire in a multi-floored building, the fire located on an upper floor vertically displaced from a lower floor from which the fire is treated, the upper and lower floors each having a selectively openable environmental access along an external wall of the multi-floored building, the apparatus comprising:

a tubular structure having an inlet, an intermediate portion, and an outlet; and a bracing system comprising:

a frame for providing support against a sturdy surface;

a displaceable pivot point supported by the frame upon which said tubular structure is supported and rotates thereon to elevate said outlet, said displaceable pivot point having a first position on said frame and a second position on said frame and responsive to movement by said tubular structure on said bracing system.

16. The apparatus of claim 15 wherein the bracing system further comprises:

a fixed pivot point upon which said tubular structure is further supported and rotates thereon to elevate said outlet.

* * * * *